United States Patent [19]

Krantz, Jr. et al.

[11] 4,029,386

[45] June 14, 1977

[54] CONNECTOR HAVING A PLATED PLASTIC GROUND FOR FILTER CONTACTS

[75] Inventors: Leonard Albert Krantz, Jr.; Jack Bernard Fort, both of Sidney, N.Y.

[73] Assignee: The Bendix Corporation, Southfield, Mich.

[22] Filed: Feb. 23, 1976

[21] Appl. No.: 660,530

[52] U.S. Cl. ..... 339/143 R

[51] Int. Cl.[2] ..... H01R 13/34

[58] Field of Search ..... 339/143 R, 143 C, 147 R, 339/13, 14 R, 258 A; 174/32, 35

[56] References Cited

UNITED STATES PATENTS

| | | | |
|---|---|---|---|
| 3,539,973 | 11/1970 | Antes et al. | 339/143 R |
| 3,670,292 | 6/1972 | Tracy | 339/143 R |
| 3,757,276 | 9/1973 | Kailus | 339/143 R |
| 3,961,294 | 6/1976 | Hollyday | 334/143 R X |

*Primary Examiner*—Roy Lake
*Assistant Examiner*—E. F. Desmond
*Attorney, Agent, or Firm*—S. H. Hartz; K. A. Seaman; R. J. Eifler

[57] ABSTRACT

A connector with a plurality of filter contact terminals having a ground wafer molded from plastic material and plated with metal and having integral spring tines for engaging the filters on the contact terminals to provide an electrical connection. The ground wafer may be seated in a cup-shaped ring made of metal and including a series of integral spring members formed in its outer circumference for engaging the shell to provide good connections for the filters.

17 Claims, 4 Drawing Figures

CONNECTOR HAVING A PLATED PLASTIC GROUND FOR FILTER CONTACTS

The invention relates to electrical connectors having one or more contact terminals in one connector and complementary contact terminals in another connector. The contact terminals mate and provide electrical circuits upon interengagement of two connectors.

The invention relates more particularly to multi-contact connectors having RF filter elements comprising either a capacitor or an inductor, or both, electrically coupled with the contact terminals of one of the connectors in order to ground out unwanted RF signals which might otherwise pass through the connector and cause interference in the associated circuit.

PRIOR ART

In order for the filter to operate properly it must be coupled to circuit ground which is at zero potential. Inductance in the ground junction or the ground itself decouples the filter and renders it ineffective. Instability in the ground junction is not conductive to good high frequency performance. Soldering the filter to ground eliminates ground inductance and provides stability in the ground junction.

One of the difficulties with soldering the filter to ground is that the filter is sometimes damaged during the soldering operation. If the soldering is faulty the filter will not operate properly. The quality of the soldered ground connection is in question until the device is tested after final assembly and, if faulty, the connector cannot be reworked and the entire connector must be scrapped.

Attempts have been made to mechanically ground the filter but the mechanical ground connections do not sufficiently reduce ground inductance or provide sufficient ground junction stability so that beyond 100 MHz the filter performance is degraded to such a degree that the filter is not effective.

One example of mechanical ground is shown in U.S. Pat. No. 3,435,387 which uses an electrically conductive gasket made of a material which includes a silicone loaded with silver coated copper beads or silver flakes. The gasket has a plurality of apertures to receive the filter on the conductors. The circumference of the aperture is less than the circumference of the associated filter so that the walls of the apertures are under stress and maintain pressure against the filter to provide an electrical path between the gasket and associated filter. The outer circumference of the gasket rests on a collar within the connector housing and engages the internal surface of the housing. The friction connection between the gasket and filter has not proved satisfactory particularly above frequencies of 100 MHz.

U.S. Pat. No. 3,569,915 attempts to solve the problem with a thin foil having tines for engaging the filters. The ground foil is fragile and not rigid enough to support itself. The foil is readily distorted resulting in uneven ground contact since the pressure is dependent upon the strength of the material. The tine thickness depends on the foil material and the length of the tines is dependent on the hole radius because the tines are punched directly from the foil. The ground spring pressure of the tines is not uniform and this prevents required consistent low ground impedance.

SUMMARY OF THE INVENTION

The present invention is directed to a multicontact filter connector having a filter ground device with integral spring tines molded from plastic material. The filter ground device is plated with gold or silver over nickel to make it electrically conductive. The spring tines engage the filter on the electrical terminal and the ground device is mechanically connected to the conductor shell for grounding the filter. The ground device can be molded from any known materials using known techniques and can be made thick enough to be self-supporting and the tines can be made stronger and of greater length than heretofore. By making the tines integral with the ground device the tines can be made to fit the contour of the filter to provide positive contact between the tines and the filter. Four or more tines are used to provide a ground connection with low impedance and for hole to hole consistency in performance.

A mechanical connection for grounding the ground device to the shell may comprise a cup-shaped ground ring made of metal and having a series of integral spring members formed in its outer circumference for engaging the inner circumference of the shell.

Elastomer seals are used at both sides of the ground device and the assembly is encapsulated with an epoxy or other suitable material to seal the filters from the effects of moisture and support the terminals to protect the filters from axial or side loads which would disturb the ground. The elastomer seals prevent the epoxy from leaking into the spring tines during encapsulation.

The invention contemplates a ground element for grounding filters on contact terminals in a connector, comprising a member having apertures therein surrounded by integral spring tines for receiving and engaging the filters on the contact terminals, the member and tines being molded from plastic material and being plated with metal to make it electrically conducting.

The invention also contemplates a connector having a plurality of filter contact terminals comprising a shell, means for retaining the contact terminals in the shell, and means for grounding the filters on the contact terminals including a ground element molded from plastic material and plated with metal and having integral spring tines for engaging the filters on the contact terminals, and means for grounding the ground element to the shell.

DRAWINGS

FIG. 1 is an axial section showing a connector constructed according to the invention, FIG. 2 is a plan view of the ground device used in the connector, FIG. 3 is a plan view of a ground ring used with the ground device, and FIG. 4 is a side view thereof.

DETAILED DESCRIPTION OF THE INVENTION

Figure 1:
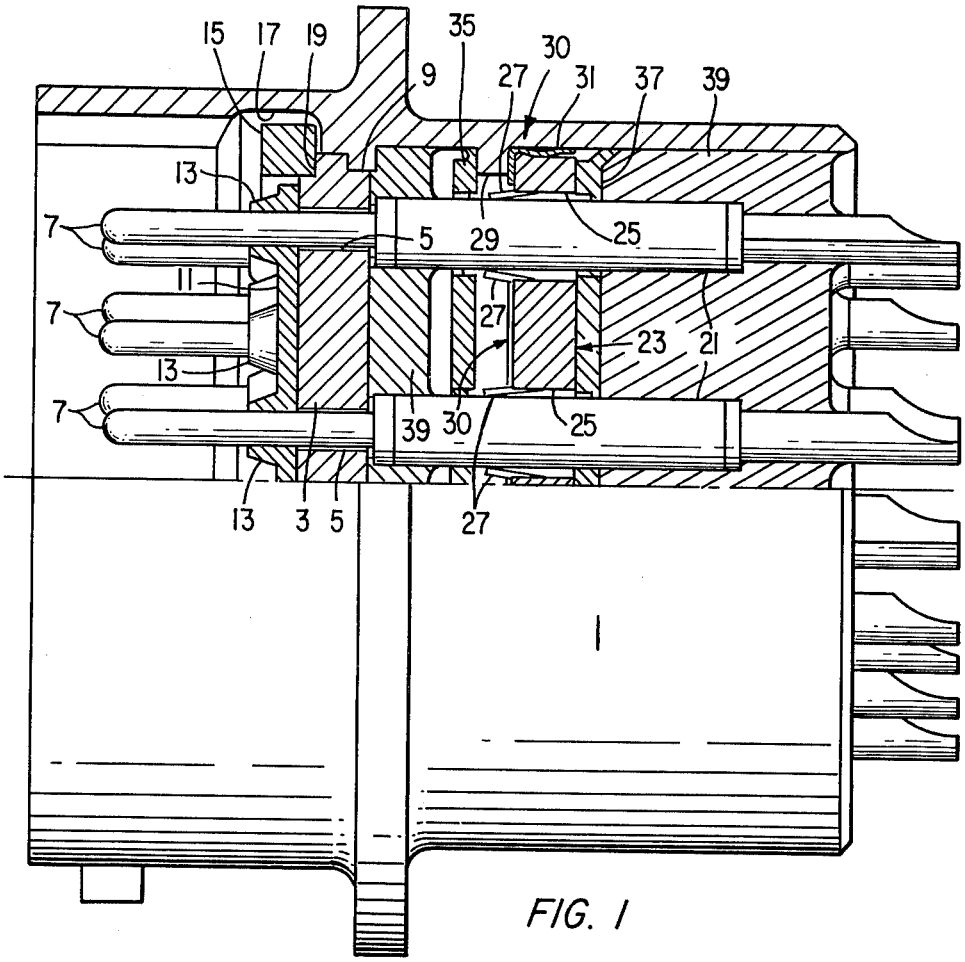
Figure 2:
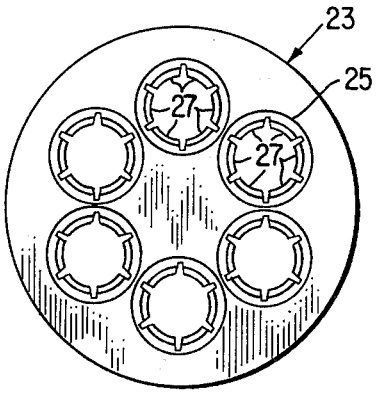
Figure 3:
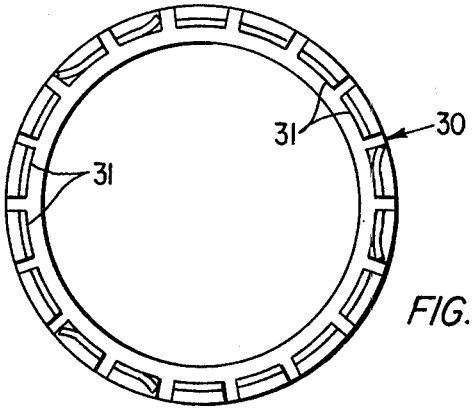
Figure 4:
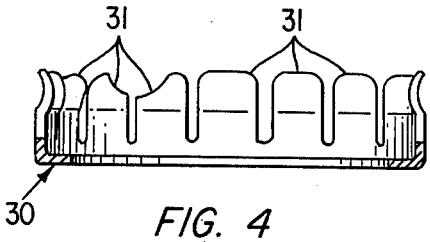

Referring to the drawings, shown therein is a novel multi-contact filter connector constructed according to the invention. The connector comprises a cylindrical shell 1 of metal or other conducting material and an insert member 3 having a plurality of apertures 5 for receiving electrical terminals 7. The insert member is positioned in the shell in abutment with a collar 9 on the inner circumference of the shell. An interfacial seal 11 is secured to insert member 3 and has a plurality of sealing towers 13 aligned with apertures 5 in the insert member for sealing the terminals. A ring shaped gasket 15 is positioned in a recess 17 in the inner circumference of shell 1 and engages a shoulder 19 on insert member 3 to provide a main joint seal. Insert member 3 and interfacial seal 11 are formed of a dielectric material so that the electrical terminals are insulated from one another.

The electrical terminals include cylindrical filter elements 21 which must be grounded to the shell for proper operation. A ground wafer 23 constructed according to the invention is made of plastic material which can be readily molded and is plated with gold or silver over nickel for electrical conductivity. The ground wafer has apertures 25 therein for receiving filter 21 on the contact terminals and has spring tines 27 associated with the apertures and formed integrally with the ground wafer for engaging the filters. The spring tines are molded to fit the contour of the filter and are longer than the radius of the associated aperture. The ground wafer is assembled to the shell and is grounded to the shell by seating the ground wafer in a shallow cup-shaped ground ring 30 seated on collar 29 within the shell. The ground ring preferably is made of metal having spring characteristics and has a series of integral spring members 31 formed in its outer circumference which engage the inner circumference of the shell.

An elastomer seal 35 of rubber, silicone, or other suitable material is positioned adjacent spring tines 27 on ground wafer 23 and engages collar 29 on the inner circumference of shell 1 and a similar seal 37 is secured to the opposite face of ground wafer 23. Epoxy 39 or other suitable material between insert member 3 and seal 37 and adjacent seal 39 substantially to the end of the shell is used to encapsulate the filter terminals 7.

A connector constructed according to the invention using a molded ground device with integral tines longer than the radius of the associated aperture and made to fit the contour of the filter provides positive contact between the tines and the filter. The ground connection has low impedance and hole to hole consistency in performance. The elastomer seals at both sides of the ground device prevent the epoxy from leaking into the spring tines during encapsulation. By encapsulating the assembly with an epoxy or other suitable material the filters are sealed from the effects of moisture and the filters are supported on the connector terminals from axial or side loads which would disturb the ground connection.

While a circular connector has been shown and described, the connector may have any convenient shape, such as rectangular, octagonal, etc. The invention is shown and described in a connector receptacle but it should be understood that the invention also is intended for use in a connector plug as well.

We claim:

1. A connector having a plurality of filter contact terminals comprising a shell, means for retaining the contact terminals in the shell, and means for grounding the filters on the contact terminals including a ground element molded from plastic material and plated with metal and having integral spring tines for engaging the filters on the contact terminals, the means for grounding the ground element to the shell.

2. A connector as described in claim 1 in which the ground element has apertures associated with the spring tines for receiving the filters and the spring tines are longer than the radius of the associated aperture.

3. A connector as described in claim 1 in which the means for grounding the ground element to the shell includes a cup-shaped member receiving the ground element and made of electrically conducting material and including a series of integral spring members formed in its outer wall for engaging the shell.

4. A connector as described in claim 3 in which the ground element is a disk and the cup-shaped member is circular in shape.

5. A connector as described in claim 1 in which the terminals are encapsulated in a thermo-setting material at each side of the ground element.

6. A connector as described in claim 5 having a seal at each side of the ground element between the ground element and encapsulating material.

7. A ground element for grounding filters on contact terminals in a connector, comprising a member having apertures therein surrounded by integral spring tines for receiving and engaging the filters on the contact terminals, the member and tines being molded from plastic material and being plated with metal to make it electrically conducting.

8. A ground element as described in claim 7 in which the spring tines are longer than the radius of the associated apertures.

9. A ground element as described in claim 8 in which the spring tines are molded to fit the contour of the filters.

10. A ground element as described in claim 8 in which the member is a disk, and means for grounding the disk to a connector shell comprising a cup-shaped ring receiving the disk and including a series of spring members formed in its outer circumference for engaging the shell.

11. A connector having a plurality of a filter contact terminals comprising:

a shell;

means for retaining the contact terminals in the shell; and means for grounding the filter contact terminals, said grounding means comprising:

a ground element and means for grounding the ground element to the shell, said ground element having apertures and made from a plastic material with a coating of metal thereon, said ground element having integral spring tines located about the apertures for engaging the filters contact terminals, with the length of the tines being longer than the radius of the aperture.

12. A connector as described in claim 11 wherein the means for grounding the ground element to the shell includes a cup-shaped member for receiving the ground element, said cup-shaped member made of electrically conducting material with a plurality of spring members formed about the periphery of the cup-shaped member for engaging the shell.

13. A connector having a plurality of filter contact terminals comprising a shell, means for retaining the contact terminals in the shell, and means for grounding the filters on the contact terminals, said grounding means comprising: a ground element made from plastic material and coated with a metallic material and having integral spring tines for engaging the filters on the contact terminals, and means for electrically connecting the ground element to the shell comprising an electrically-conducting cup-shaped member receiving the ground element and including a series of integral spring members formed on its outer wall for engaging the shell.

14. A connector as described in claim 13 in which the ground element is a disc and the cup-shaped member is circular in shape and complimentary with the disc.

15. A connector as described in claim 11 wherein the ground element includes a forward face and a rearward face and said terminals are encapsulated in a thermosetting material disposed forwardly and rearwardly of the ground element, with a first seal between the forward face of the grounding element and the forward encapsulating material and between the rearward face and the rearward encapsulating material.

16. A ground element for grounding filters on contact terminals in an electrical connector, comprising: a member having a plurality of apertures therein, each aperture surrounded by a plurality of integral spring tines, each tine having a length longer than the radius of the associated aperture, wherein said apertures and tines receive and engage the filters on the contact terminals, the member and tines being molded from plastic material and being plated with metal to make them electrically conducting.

17. A ground element as described in claim 16 in which the member is disk-shaped and the ground element further comprises: means for grounding the disk to a connector shell comprising a cup-shaped ring receiving the disk and including a series of spring members formed in the outer periphery of the cup-shaped ring for engaging the shell.

* * * * *